US005885677A

United States Patent [19]

Gosselin et al.

[11] Patent Number: 5,885,677

[45] Date of Patent: Mar. 23, 1999

[54] SECURITY LABEL WITH DIFFUSING INDENTIFIER MEDIUM AND METHOD OF MAKING SAME

[75] Inventors: Raymond R. Gosselin, Stillwater; Walfredo M. Marfori, Cottage Grove, both of Minn.

[73] Assignee: Minnesota Mining and Manufacturing Company, St. Paul, Minn.

[21] Appl. No.: 637,019

[22] Filed: Apr. 24, 1996

[51] Int. Cl.[6] ..... G09F 3/00

[52] U.S. Cl. ..... 428/40.1; 40/299; 283/81; 283/101; 428/40.2; 428/40.5; 428/41.6; 428/42.1; 428/42.2; 428/42.3; 428/915

[58] Field of Search ..... 428/40.1, 915, 428/40.2, 40.5, 41.6, 41.7, 41.8, 42.1, 42.2, 42.3; 40/299; 283/81, 101

[56] References Cited

U.S. PATENT DOCUMENTS

| | | | |
|---|---|---|---|
| Re. 24,906 | 12/1960 | Ulrich | 206/59 |
| 2,407,680 | 9/1946 | Palmquist | 88/82 |
| 3,700,305 | 10/1972 | Bingham | 350/105 |
| 4,025,159 | 5/1977 | McGrath | 350/105 |
| 4,268,983 | 5/1981 | Cook | 40/2.2 |
| 4,841,652 | 6/1989 | Sakashidta et al. | 40/299 |
| 4,987,287 | 1/1991 | Jack | 219/121 |
| 5,042,842 | 8/1991 | Green et al. | 283/101 |
| 5,151,572 | 9/1992 | Jack | 219/121 |
| 5,325,721 | 7/1994 | Pendergrass | 428/915 |
| 5,582,887 | 12/1996 | Etheredge | 428/915 |

FOREIGN PATENT DOCUMENTS

| | | |
|---|---|---|
| 38 13 303 | 7/1989 | Germany . |
| 42 31 800 | 3/1994 | Germany . |

OTHER PUBLICATIONS

Brochure entitles "Anti–Theft Labeling and Window–Etching Systems"; Avery Dennison Co., undated, 3 pgs.

Brochure entitled "Confirm™ Automotive Security Labeling System"; Automotive Systems Division/3M; Form No. 70–0701–2322–2(78.25)BPH; undated; 6 pgs.

Brochure entitled "The Stencilight™ and genugraphic™ Vehicle Security Marking Systems"; Avery Dennison Co., undated, 5 pgs.

*Primary Examiner*—Nasser Ahmad

*Attorney, Agent, or Firm*—Karl Schwappach; Peter L. Olson

[57] ABSTRACT

A security label with a sheet material having a first major surface. An adhesive layer containing an identifier medium is coated on the first major surface. A barrier medium is selectively applied on an exposed surface of the adhesive layer for at least partially blocking diffusion of the identifier medium from the adhesive layer into a substrate. A release liner may be provided that extends substantially over the exposed surface of the adhesive layer. A method of preparing the security label includes applying a barrier medium in the form of an identifier pattern to a low energy surface material. The low energy surface material is laminated to a security label having an adhesive layer containing an identifier medium. When the low energy surface material is removed from the adhesive layer, the barrier medium substantially transfers to the adhesive layer to block diffusion of the identifier medium into a substrate.

17 Claims, 2 Drawing Sheets

SECURITY LABEL WITH DIFFUSING INDENTIFIER MEDIUM AND METHOD OF MAKING SAME

FIELD OF THE INVENTION

The present invention relates to a security label with an identifier medium that diffuses into the substrate on which it is attached and method of making the same, and more particularly, a method and apparatus for forming a security label that selectively blocks the diffusion of an identifier medium into the substrate to form an identifier pattern.

BACKGROUND OF THE INVENTION

Stolen and counterfeit replacement parts, particularly for automobiles, cost legitimate manufacturers billions of dollars in lost sales each year. Counterfeit and stolen articles can be extremely difficult to identify. The ability to track the ownership or verify the authenticity of an article throughout the distribution chain has become more important than ever.

Simple printed labels containing an identifier can be easily counterfeited. Manufacturing products with embossed or permanently formed identifiers can be extremely expensive.

U.S. Pat. Nos. 4,987,287 and 5,151,572 issued to Jack disclose use of a laser light beam to selectively cut or vaporize the adhesive and the label stock to form a stencil template containing an identifier. The adhesive contains an etchant or UV fluorescent dye. The etchant etches the substrate or the fluorescent dye diffuses into the substrate, leaving a negative fluorescent dye footprint of the identifier on a substrate. Using of a laser beam to cut a stencil, however, may weaken the label stock. Additionally, the required laser equipment may be cost prohibitive for some applications and is not particularly convenient for most users.

German Patent No. DE 38 13 303 discloses a self adhesive label and printing process in which an ink that contains a non-volatile thinner is printed onto carrier foil. The carrier foil containing the ink is adhered to the self adhesive label. The ink is absorbed from the carrier foil by the adhesive. When the self adhesive label is placed on a substrate, the non volatile thinner diffuses over time into the surface of the substrate, leaving traces in the substrate.

SUMMARY OF THE INVENTION

The present invention relates to a security label with an identifier pattern that diffuses into the substrate on which it is attached and method of making the same.

The present invention also relates to a method and apparatus for selectively blocking the diffusion of an identifier medium located in or on an adhesive into the substrate on which it is attached.

The security label includes a sheet material having a first major surface. An adhesive layer containing an identifier medium is applied to the first major surface. A barrier medium is selectively applied on an exposed surface of the adhesive layer for at least partially blocking diffusion of the identifier medium from the adhesive layer into a substrate.

A release liner may be provided that extends substantially over the exposed surface of the adhesive layer. In one embodiment, the barrier medium completely blocks diffusion of the indicator medium into the substrate.

The sheet material may be selected from a group consisting of polyester, paper, polyvinyl chloride, polyolefin, polycarbonate, cellulose acetate, or metal foils. In one embodiment, the sheet material is a retroreflective material.

Preferably, the adhesive layer substantially covers the first major surface. The identifier medium preferably is a UV-fluorescent dye. Alternatively, the identifier medium may be a reactive chemical that will etch, coat or otherwise chemically react with the surface of the substrate to which the label is attached. In another embodiment, the barrier medium at least partially blocks chemical reactions of the identifier medium with the substrate.

The barrier medium may comprise constituents selected from a group consisting of resin, wax or a film-forming resin. The barrier medium is preferably configured as alphanumeric characters or a geometric pattern. In an alternate embodiment of the invention, the barrier medium is opaque or colored such that it provides an optical contrast with the background appearance of the sheet material or the substrate.

The present invention is also directed to a method of preparing a security label. An adhesive layer is applied to a first major surface of a sheet material. The adhesive layer contains an identifier medium. A barrier medium is selectively applied on an exposed surface of the adhesive layer. The barrier medium may be applied by printing or a variety of imaging processes to form alphanumeric characters or geometric shapes. The barrier medium at least partially blocks diffusion of the identifier medium from the adhesive layer on or in to a substrate. A release liner may optionally be applied to the exposed surface of the adhesive layer.

In one embodiment, the barrier medium is selectively applied to a backing layer. The backing layer is then laminated to the adhesive layer. The barrier medium preferably has lower adhesion to the backing layer than to the adhesive, such as with a low energy surface. When the backing layer is removed, substantially all of the barrier medium transfers to the adhesive layer.

The present invention is also directed to a kit for preparing a security label attachable to a substrate. The kit includes a sheet material with an adhesive layer containing an identifier medium coated or laminated on a first major surface thereof. A low energy surface release liner is provided for receiving a barrier medium configured to form an identifier pattern. The release liner is laminated to the adhesive layer and removed. When the security label is applied to a substrate, the barrier medium at least partially blocks diffusion of the identifier medium from the adhesive layer into the substrate.

As used in this application,

Barrier Medium refers to any compound that can be selectively applied to partially or completely blocks the migration or diffusion of an additive from the adhesive to the substrate.

Identifier Pattern refers to any symbol, alphanumeric character, logo, bar code, seal or geometric pattern.

Identifier Medium refers to an additive compound in an adhesive layer that migrates or diffuses into, etches, coats or otherwise chemically reacts with a substrate, such as an ultraviolet dye, infrared dye, magnetic ink, colored dye, or combinations thereof.

DETAILED DESCRIPTION OF THE PREFERRED EMBODIMENT

Figure 1:
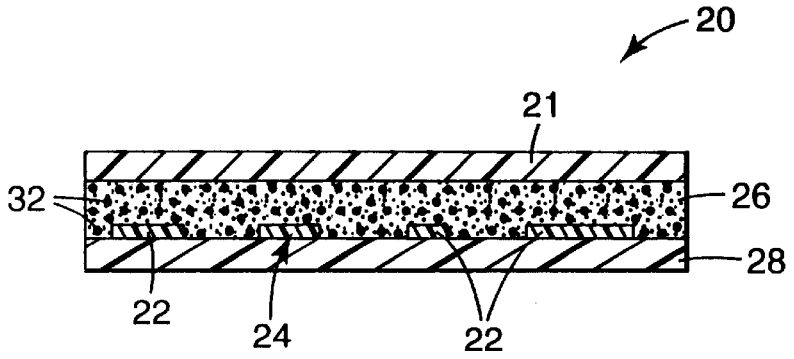
FIG. 1 is a cross-sectional view of an exemplary security label for selectively blocking the diffusion of an identifier medium located in an adhesive into the substrate.

FIG. 1 illustrates an exemplary security label 20 according to the present invention. An adhesive layer 26 is applied to a sheet material 21. The adhesive layer 26 of the label 20 preferably contains a diffusible identifier medium 32, such as a UV-fluorescent dye. A barrier medium 22 configured to produce an identifier pattern 24, such as a code, personal identification number or vehicle identification number is located on the adhesive layer 26. The barrier medium 22 may be directly printed on the adhesive layer 26 of the label 20. Alternatively, the barrier medium 22 may be printed on a backing layer 28, such as a low energy silicone coated release liner and then laminated to the adhesive layer 26. The barrier medium 22 preferably has lower adhesion to the backing layer 28 than to the adhesive layer 26. At least a portion of the barrier medium 22 is transferred to the adhesive layer 26 when the backing layer 28 is subsequently removed from the security label 20.

Figure 2:
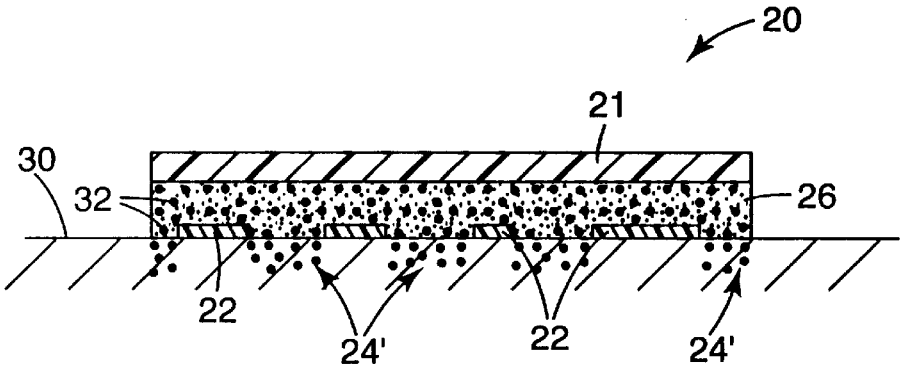
FIG. 2 is a cross-sectional view of the security label of FIG. 1 adhered to a substrate.

FIG. 2 is a cross-sectional view of the label 20 adhered to a substrate 30. The barrier medium 22 acts as a selective barrier to at least partially block the diffusion of the identifier medium 32 into the surface of the substrate 30, thereby creating a negative footprint or image of the identifier pattern 24' on the substrate 30. In an embodiment in which the identifier medium 32 is a UV-fluorescent dye, UV detection of the presence of fluorescent dye in or on the substrate 30 would indicate removal of the label 20 and the negative footprint or image where no UV-dye was present would indicate the identifier pattern 24'.

Figure 3:
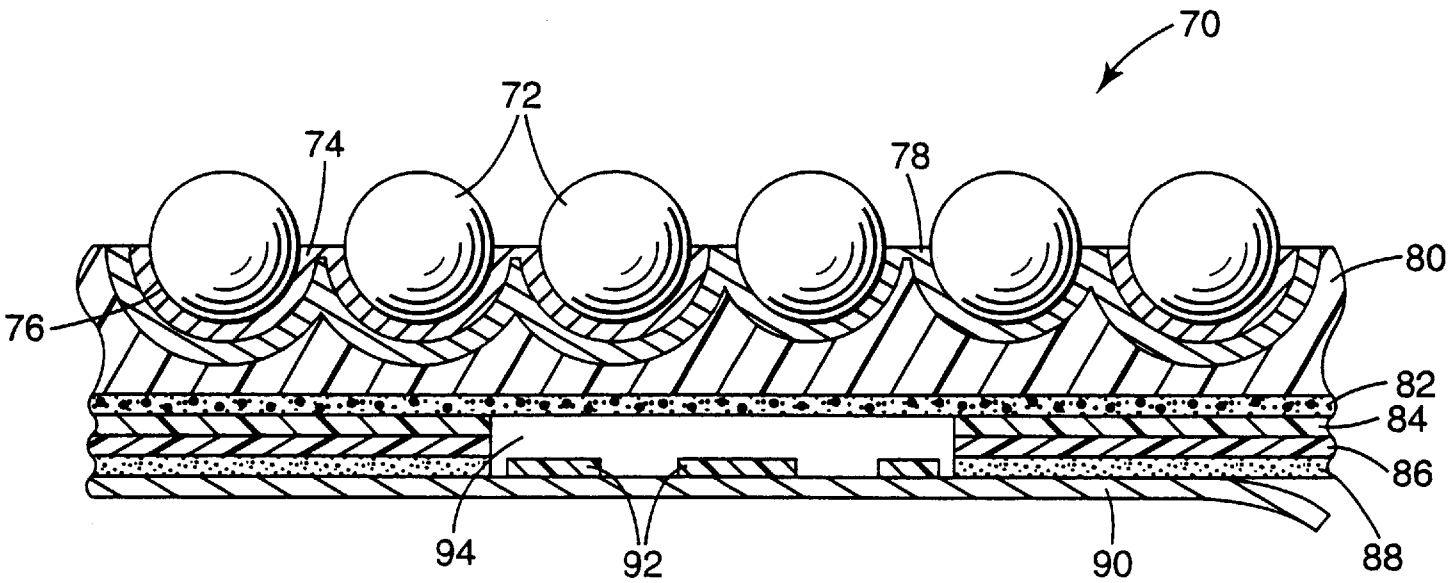
FIG. 3 is a schematic illustration of an exemplary security label according to the present invention containing a retroreflective layer.

FIG. 3 is a cross-sectional area of a security label 70 having an exposed monolayer of glass microspheres 72. A partial layer 74 in the form of an identifier pattern is located opposite a back surface 76 of microspheres 72. The layer 74 is a transparent material having a refractive index less than the refractive index of the glass in microspheres 72. A layer 78 of material having a refractive index larger than the refractive index of the glass in microspheres 72 is located on the back of the microspheres 72 and the layer 74. Reflections from the interface between the glass microspheres 72 and layer 78 facilitate a first level of retroreflectivity in areas where layer 74 is not present. Reflections from the interface between the glass microspheres 72 and layer 74, and the interface between layers 74 and 78, provide a second enhanced level of retroreflection in areas of the layer 74. The microspheres 72, layer 74, and layer 78 are retained in a polymer binder 80. The latent retroreflective pattern 74 registers discontinuity from alterations and tampering.

A pressure sensitive adhesive layer 82 containing a UV-fluorescent dye is attached to a surface of the binder 80 opposite the microspheres 72. A visible identifier pattern 84 is preferably applied to a support layer 86. A second adhesive layer 88 is applied to the support layer 86. A release liner 90 containing barrier medium 92 is positioned over the second adhesive layer 88. The barrier medium 92 is preferably applied to the release liner 90 proximate a window region 94 opposite the first pressure sensitive adhesive layer 82. When the release liner 90 is removed from the label 70, at least a portion of the barrier medium 92 transfers to the adhesive layer 82 to at least partially block diffusion of the UV-fluorescent adhesive dye in or on a substrate, as discussed herein. A security label with a layer of glass microspheres is disclosed in U.S. Pat. No. 4,268,983 issued to Cook, which is hereby incorporated by reference. A commercially available label having a similar structure suitable for use with the present invention is sold under the product designation Confirm™ automotive security labeling system available from Minnesota Mining and Manufacturing Company of St. Paul, Minn.

Illustrative examples of a microsphere-type and a cube-corner type encapsulated lens retroreflector that may be used in the present invention are disclosed in U.S. Pat. Nos. 3,700,305 to Bingham and 4,025,159 to McGrath, which are hereby incorporated by reference. An illustrative example of an enclosed lens retroreflector that may be used in the present invention is disclosed in U.S. Pat. No. 2,407,680 to Palmquist, which is also incorporated by reference. A variety of commercially available retroreflector products may also be used. For example, enclosed lens retroreflectors with and without a transparent film covering include Scotchlite® brand reflective sheeting products Series 3750 and 4750, respectively, available from Minnesota Mining and Manufacturing Company ("3M"), St. Paul, Minn. An example of a flexible, encapsulated retroreflector includes Scotchlite® brand reflective sheeting products Series 3810-I available from 3M, St. Paul, Minn. Examples of commercially available prismatic retroreflectors include Scotchlite® brand reflective sheeting products Series 3990 and 3970G available from 3M, St. Paul, Minn.

It will be understood that a wide variety of sheet materials 21 may be used with the present invention. For example, paper stock, polyester, polyvinyl chloride, polyolefin, polycarbonate, cellulose acetate, or metal foils may be used for the sheet material of the present invention. For purposes of achieving tamper resistance, it may be sufficient for some applications that ordinary paper label stock be used for the sheet material since removal of the label will not reverse diffusion of the identifier medium into the substrate. The sheet material preferably has a thickness of about 0.051–0.102 mm (0.002 to 0.004 inches). The sheet material preferably includes a top coat layer to enhance printability, such as polyester resin.

A wide variety of release liners may be used. The release liner typically includes a backing, such as of paper or polymeric film, treated with a release agent such as a polysiloxane or other silicone-based release materials. It will be understood that it is sufficient for most applications that the barrier medium have a lower adhesion to the release liner than the adhesive layer.

Many adhesives are useful in the labels of the present invention, such as an acrylic based pressure-sensitive adhesive taught in U.S. Pat. No. Re. 24,906, which is hereby incorporated by reference. Rubber-resin pressure-sensitive adhesives that can be heat- or solvent activated may be used. Other pressure sensitive adhesives can be prepared using polyacetate, polyolefin polyalpha-olefin, polyurethane or silicone.

The indicator medium is preferably a relatively stable and non-transferable UV-fluorescent dye. UV dye is known to penetrate painted surfaces and plastics, such as polypropylene, polyethylene, and polystyrene. Commercially available UV-fluorescent dyes are available under the product designation Uvitex OB from Ciba-Geigey Corporation located in Hawthorne, N.Y. and Calcoflour Dye from BASF located in Holland, Mich. Some commercially available adhesives containing a UV-fluorescent dye are sold under the product designations 9458U and 992U, available from Minnesota Mining and Manufacturing of St. Paul, Minn. The 992U adhesive is available in a thickness of about 0.050 mm (0.002 inches) with a liner 0.081 mm (0.0032 inches) thick.

It will be understood that a variety of additives that are capable of migrating, diffusing, coating or chemically reacting with a receptive substrate may be used as the identifier medium, such as an infrared dye, magnetic ink, visible colored dye materials, ultraviolet dye, or combinations thereof The identifier medium is preferably selected based upon the target substrate. For example, UV-fluorescent dye readily penetrates a variety of plastics and painted metal surface, but not glass or unpainted metal. As a further example, methyl salicylate etches ABS plastic (acrylonitrile butadiene styrene resin) It will also be understood that the barrier medium may need to be tailored to the identifier medium selected.

Visible dyes are available from BASF of Holland, Mich. under the product designations Basonyl Red 482, Sudan Orange 220, Sudan Yellow 146, Basonly Red 481, Basonly Red 560, and Basacid Yellow 226. A laminating adhesive with a visible red dye is available under the product designation 9458R from Minnesota Mining and Manufacturing Company of St. Paul, Minn.

The identifier medium is preferably uniformly distributed within the adhesive layer. It will be understood that non-uniform distribution of the identifier medium may be desirable for some applications. Additionally, two or more different identifier mediums may be combined within a single adhesive layer. For example, an identifier medium gradient may be used as a further security feature to prevent unauthorized duplication of the security labels of the present invention.

The barrier medium preferably is a conventional ink or thermal mass transfer material that contains sufficient mass to at least partially block diffusion of the identifier medium. It will be understood that the barrier medium need not be a complete barrier to diffusion or migration of the identifier medium. For some applications it may be sufficient that the barrier medium slow the rate of diffusion of the indicator medium. Resin or wax may be added to the barrier medium to enhance barrier properties. For example, the barrier medium may be constructed of resin and/or wax plus dye or pigment and additives.

Figure 4:
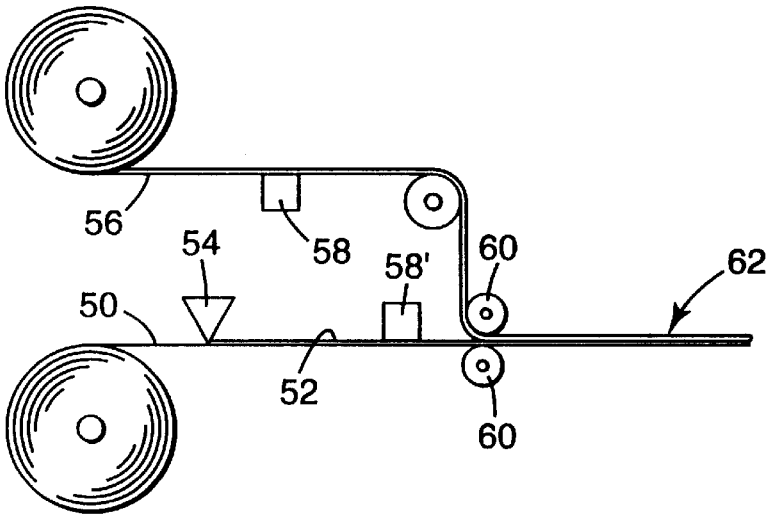
FIG. 4 is a schematic illustration of an exemplary method of making the present security labels.

As illustrated in FIG. 4, one embodiment of the method of the present invention involves coating a sheet material 50 with an adhesive layer 52 containing an identifier medium at a coating station 54. The identifier medium is preferably a UV-fluorescent dye. A barrier medium configured to form an identifier pattern is then coated, printed or transferred onto the exposed surface of the adhesive at printing station 58'. Alternatively, the barrier medium is coated or printed onto a low energy material 56, such as a release liner, at a printing station 58. The coated or printed side of the low energy material 56 is laminated with the adhesive layer 52 of the sheet material 50 at a nip roll 60 to form security label 62. When the sheet material 50 is subsequently removed from the low energy material 56, the barrier medium is substantially contained on the adhesive layer 52. The security label 62 is then attached to a substrate. The barrier medium serves to at least partially block diffusion or migration of the identifier medium into a substrate. If the security label 62 is removed from the substrate, the resulting footprint will contain a negative image of the indicator formed from the barrier medium. The resulting footprint or image on the substrate will typically depend upon the substrate composition, dwell time of the label prior to removal and temperature. Higher temperatures will enhance the rate of transfer and the depth of penetration.

The present invention may be directed to a kit for preparing security labels according to the present invention. The kit preferably contains a low energy release liner sheet material, although a variety of backing layers may be used. The user prints the desired identifier pattern onto the release liner using conventional means, such as a typewriter, laser printer, thermal printer, ink jet printer, felt tipped marker, or other means. The release liner containing the printed identifier pattern can be manually laminated to the adhesive layer of the security label. The adhesive layer contain an identifier medium. When the user removes the security label from the printed release liner, the barrier medium is substantially transferred to the adhesive layer. The security label can then be attached to a substrate. The barrier medium on the adhesive layer operates to selectively block migration or diffusion of the identifier medium into the substrate.

EXAMPLES

Example 1

Using a No. 30001 Black Sharpie Brand Fine Point Permanent Marker from Sanford Corporation of Bellwood, Ill., numbers 1–9 were written on the adhesive side of the Confirm Brand 1700 Series Automotive Security (or VIN) Label. The 1700 Series Label is available from 3M Company of St. Paul, Minn. The printed samples were applied to a white painted panel using finger pressure. The laminated samples were placed in an oven at 150° F. to accelerate aging for various durations from 10 minutes to 1 day. The labels were removed from the painted panels. Using a UV fluorescent light, a negative mirror image of the numbers 1–9 was visible within a UV-fluorescent area.

Example 2

Numbers and letters were printed on a Scotchcal 3650 silicone release liner using a Hewlett Packard LaserJet III Printer from Hewlett Packard Corporation from Palo Alto, Calif. The Scotchcal 3650 silicone liner is available from 3M Company of St. Paul, Minn. Confirm Brand Series 1700 VIN (vehicle identification number) labels from 3M Company of St. Paul, Minn. were placed with the adhesive surface 82 in contact with the printed numbers and letters 92. Finger pressure was applied on the labels. When the labels were removed from the releasable liner, the printed alphanumeric characters transferred to the adhesive side of the label. The samples were then applied to a white painted panel and aged in an oven at 150° F. for 30 minutes. When the labels were removed from the painted panel, a negative image of the alphanumerics within a UV-fluorescent footprint area could be read using UV light.

Example 3

Numbers were printed on Scotchcal 3650 silicone release liner as in Example 2 but using a Markem Touchdry Inkjet Printer Model 962 from Markem Corporation of Keene, N.H. Confirm Brand Series 1700 VIN labels as in Example 2 were placed on top of the printed numbers. When the labels were removed from the release liner, the printed numbers transferred to the adhesive side of the VIN label. The labels were applied to a white painted panel and polystyrene substrates and aged at room temperature for seven days and at 150° F. degrees from 30 minutes to 3 days.

When the labels were removed from the painted panel, a negative image of the alphanumerics within a UV-fluorescent footprint area could be read using UV light.

Example 4

An acrylic pressure sensitive adhesive with UV dye available under the product designation 9458U adhesive, was laminated to the adhesive side of tape sold under the product designation 810 tape. The 9458U adhesive is available in a thickness of about 0.025 mm (0.001 inches) with a liner 0.08 mm (0.0032 inches) thick. Both the 9458U adhesive and 810 Tape are available from 3M Company of St. Paul, Minn. Alphanumerics were printed on a Scotchcal 3650 silicone liner as in Example 2 using a Hewlett Packard LaserJet III printer. The piece of 810 Tape laminated with the 9458U adhesive was placed on the printed Scotchcal Brand release liner, transferring the alphanumerics to the adhesive side of the 810 tape. The 810 tape was applied to a white painted panel and aged for 10 minutes at 150° F. When the label was removed from the painted panel, a negative image of the alphanumerics within a UV-fluorescent footprint area could be read using UV light.

Example 5

An adhesive sold under the product designation 9458U was laminated to the adhesive side of paper label stock sold under the product designation 7110. Both the 9458U adhesive and 7110 label stock are available from 3M Company of St. Paul, Minn. Alphanumerics were printed on a Scotchcal 3650 silicone liner using a Hewlett Packard LaserJet III Printer, as in Example 2. The piece of 7110 label stock laminated with 9458U adhesive was placed on top of the printed silicone liner, transferring the alphanumerics to the adhesive side of the label stock. The label was applied to a white painted panel and aged for 30 minutes at 150° F. When the label was removed, a negative image of the alphanumerics could be read using UV light.

Example 6

An acrylic red footprint laminating adhesive sold under the product designation 9458R was laminated to a facestock sold under the product designation 8053 Matte Silver Polyester facestock. Both of these materials are available from 3M Company of St. Paul, Minn. Alphanumerics were printed on a Scotchcal Brand 3650 liner using a Hewlett Packard Laserjet III Printer, as in Example 2. The piece of 8053 Polyester facestock laminated with 9458R adhesive was placed on top of the printed liner, transferring the alphanumerics to the adhesive side of the label. The label was applied to a white painted panel and aged for 30 minutes at 150° F. When the label was removed, a negative visible image of the alphanumerics could be read within a non-red footprint area.

Example 7

Encapsulated methyl salicylate was mixed into 9458R adhesive at 8% by weight. The methyl salicylate was encapsulated to prevent it from evaporating during the coating and drying process of the solvent based adhesive. An indicator pattern was printed onto a 0.051 mm (0.002 inch) thick biaxially oriented polypropylene film using a Dataproducts JOLT PSe solid ink color printer. A layer 0.076–0.127 mm (0.003–0.005 inches) thick of the adhesive was coated onto a polycoated Kraft liner and dried at 150° F. for 15 minutes. The adhesive was then laminated to a 0.051 mm (0.002 inch) thick aluminum foil. The liner was removed and the exposed adhesive was laminated to the polypropylene film. When the polypropylene film was removed, the indicator pattern substantially transferred to the adhesive layer. A portion of the sample was laminated using a squeegee to rupture the capsules to a panel of ABS plastic. When the label was removed a red negative visible image of the identifier pattern could be read within a non-red footprint area.

The present invention has now been described with reference to several embodiments described herein. It will be apparent to those skilled in the art that many changes can be made in the embodiments without departing from the scope of the invention. Thus, the scope of the present invention should not be limited to the structures described herein, but only to structures described by the language of the claims and the equivalents to those structures.

What is claimed is:

1. A security label adherable to a substrate, comprising:

a sheet material having a first major surface;

an adhesive layer containing an identifier medium coated on the first major surface; and a barrier medium applied in a selected pattern on an exposed surface of the adhesive layer;

such that when the label is adhered to the substrate, the barrier medium at least partially blocks diffusion of the identifier medium from the adhesive layer into the substrate in the selected pattern.

2. The article of claim 1 wherein the sheet material comprises constituents selected from the group consisting of polyester, paper, polyvinyl chloride, polyolefin, polycarbonate, cellulose acetate, and metal foils.

3. The article of claim 1 wherein the sheet material comprises a retroreflective material.

4. The article of claim 1 wherein the adhesive layer substantially covers the first major surface.

5. The article of claim 1 wherein identifier medium is selected from the group consisting of UV-fluorescent dye, infrared dye, magnetic ink, colored dye, and combinations thereof.

6. The article of claim 1 wherein identifier medium comprises a compound chemically reactive with the substrate.

7. The article of claim 1 wherein the barrier medium comprises constituents selected from the group consisting of ink, resin and wax.

8. The article of claim 1 wherein the barrier medium applied on a portion of an exposed surface of the adhesive layer comprises an alphanumeric identifier pattern.

9. The article of claim 1 wherein the barrier medium applied on a portion of an exposed surface of the adhesive layer comprises a geometric pattern.

10. The article of claim 1 wherein the barrier medium completely blocks diffusion of the indicator medium into the substrate.

11. The article of claim 1 wherein the barrier medium comprises a compound optically contrasting with the adhesive layer.

12. The article of claim 1 wherein the barrier medium comprises a compound optically contrasting with the substrate.

13. The article of claim 1 further including a release liner extending substantially over the exposed surface of the adhesive layer.

14. The article of claim 1 wherein the indicator medium is uniformly distributed within the adhesive layer.

15. A security label adherable to a substrate comprising:

a sheet material having a first major surface;

an adhesive layer containing an identifier medium applied on the first major surface; and a barrier medium applied in a selected pattern on an exposed surface of the adhesive layer;

such that when the label is adhered to the substrate, the barrier medium at least partially blocks chemical reaction of the identifier medium with the substrate in the selected pattern.

16. A security label adhered to a substrate, comprising:

a sheet material having a first major surface;

an adhesive layer containing an identifier medium coated on the first major surface;

a barrier medium applied in a selected pattern on an exposed surface of the adhesive layer; and a substrate;

wherein the label is adhered to the substrate, and wherein the barrier medium at least partially blocks diffusion of the identifier medium from the adhesive layer into the substrate in the selected pattern.

17. A security label adherable to a substrate, comprising:

a sheet material having a first major surface;

an adhesive layer containing an identifier medium coated on the first major surface of the sheet material;

a release liner having a first major surface wherein the first major surface of the release liner covers the adhesive layer; and a barrier medium printed in a selected pattern on the first major surface of the release liner;

such that when the label is adhered to the substrate, the barrier medium at least partially blocks diffusion of the identifier medium from the adhesive layer into the substrate in the selected pattern.

* * * * *